US005625393A

United States Patent [19]

Asai

[11] Patent Number: 5,625,393

[45] Date of Patent: Apr. 29, 1997

[54] INK EJECTING APPARATUS WITH EJECTING CHAMBERS AND NON EJECTING CHAMBERS

[76] Inventor: Hiroki Asai, 2-78, Nabekata, Shinkawa-cho, Nishikasugai-gun Aichi-ken, Japan

[21] Appl. No.: 321,614

[22] Filed: Oct. 12, 1994

[30] Foreign Application Priority Data

Nov. 11, 1993 [JP] Japan ..... 5-282368

[51] Int. Cl.[6] ..... B41J 2/045

[52] U.S. Cl. ..... 347/69; 347/68; 347/71; 347/94

[58] Field of Search ..... 347/20, 21, 68, 347/69, 71, 94, 67; 29/25.35

[56] References Cited

U.S. PATENT DOCUMENTS

| | | | |
|---|---|---|---|
| 3,946,398 | 3/1976 | Kyser et al. | 347/68 |
| 4,536,097 | 8/1985 | Nilsson | 347/71 |
| 4,723,129 | 2/1988 | Endo et al. . | |
| 4,752,788 | 6/1988 | Yasuhara et al. | 347/68 |
| 4,825,227 | 4/1989 | Fischbeck et al. | 347/69 |
| 4,842,493 | 6/1989 | Nilsson | 417/322 |
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,359,354 | 10/1994 | Hiraishi et al. | 347/69 |
| 5,410,341 | 4/1995 | Sugahara et al. | 347/69 |
| 5,421,071 | 6/1995 | Kanegae et al. | 29/25.35 |
| 5,432,540 | 7/1995 | Hiraishi | 347/69 |
| 5,477,247 | 12/1995 | Kanegae | 347/20 |

FOREIGN PATENT DOCUMENTS

| | | |
|---|---|---|
| 484983A2 | 5/1992 | European Pat. Off. . |
| 2264086 | 8/1993 | United Kingdom . |
| 2265113 | 9/1993 | United Kingdom . |

*Primary Examiner*—Benjamin R. Fuller
*Assistant Examiner*—Charlene Dickens

[57] ABSTRACT

An ink ejecting apparatus is composed of a piezoelectric ceramics plate, a cover plate, and a nozzle plate. The piezoelectric ceramics plate is provided with a plurality of grooves. The cover plate is composed of a front plate and a rear plate. The rear plate is provided with a plurality of ink inlet holes and a manifold. The cover plate is bonded to the piezoelectric ceramics plate to define a plurality of ink chambers communicating with the manifold through the ink inlet holes and a plurality of air chambers that do not communicate with the manifold.

26 Claims, 10 Drawing Sheets

INK EJECTING APPARATUS WITH EJECTING CHAMBERS AND NON EJECTING CHAMBERS

BACKGROUND OF THE INVENTION

1. Field of the Invention

The invention relates to an ink ejecting apparatus.

2. Description of the Related Art

Conventional impact printers are now being replaced by nonimpact printers and the market for the nonimpact printers is expanding. As one type of nonimpact printers, there is known an ink ejecting printer which is simplest in principle and can easily effect multi-scale or color printing. Of all the types of ink ejecting printers, a drop-on-demand type ink ejecting printer capable of ejecting ink droplets at a required time only in printing has rapidly spread owing to its good ejecting efficiency and its low operating cost.

As typical examples of such a drop-on-demand type ink ejecting printer, there are what is known a Kyser type as disclosed in U.S. Pat. No. 3,946,398 and a thermal ejecting type as disclosed in U.S. Pat. No. 4,723,129, for example. However, the former is hard to reduce in size, and the latter is required to have a high heat resistance of the ink because the ink undergoes a high temperature. Thus, both types have very severe problems.

To solve the above problems at the same time, there has been newly proposed a shear mode type as disclosed in U.S. Pat. No. 4,879,568.

FIGS. 13A and 13B show such a shear mode type ink ejecting apparatus of the related art. Referring to FIG. 13A, reference numeral 500 generally denotes a shear mode type ink ejecting apparatus composed of a base wall 601, a top wall 602, and a plurality of shear mode actuator walls 603 extending between the base wall 601 and the top wall 602. Each actuator wall 603 is composed of a lower wall part 607, bonded to the bottom wall 601 and polarized in a direction shown by an arrow 611, and an upper wall part 605, bonded to the top wall 602 and polarized in a direction shown by an arrow 609. The actuator walls 603 are arranged in pairs to define ink channels 613 therebetween. There are defined spaces 615, narrower than the ink channels 613, between successive pairs of the actuator walls 603 which define the ink channels 613.

Referring to FIG. 13B, a nozzle plate 617 having a plurality of nozzles 618 is fixed to one end of each ink channel 613, and electrodes 619,621 are each provided as metallized layers on both side surfaces of each actuator wall 603. The electrodes 621 are on upper wall part 605 and the electrodes 619 are on lower wall part 607. The electrodes 619,621 are covered with insulating layers (not shown) for insulation from ink. The electrodes 619,621, disposed in the spaces 615, are connected to a ground 623, whereas the electrodes 619,621 disposed in the ink channels 613 are connected to a silicon chip 625 which provides actuator driving circuits.

The ink ejecting apparatus 600 is manufactured in the following manner. First, a piezoelectric ceramics layer polarized in the direction 611 is bonded to the bottom wall 601, and another piezoelectric ceramics layer polarized in the direction 609 is bonded to the top wall 602. The thickness of each piezoelectric ceramics layer is equal to the height of each lower wall part 607 and the height of each upper wall part 605. Parallel grooves are next formed on each piezoelectric ceramics layer by rotation of diamond cutting disks, for example, thereby forming the lower wall parts 607 and the upper wall parts 605. The electrodes 619 are next formed on the opposite side surfaces of the lower wall parts 607 by vapor deposition, and the insulating layer is then provided on the electrodes 619. Similarly, the electrodes 621 and the insulating layer are provided on the opposite side surfaces of the upper wall parts 605.

Lower ends of the upper wall parts 605 and upper ends of the lower wall parts 607 are bonded together, respectively, to define the ink channels 613 and the spaces 615. Then, the nozzle plate 617, through which the nozzles 618 have been formed, is bonded to one end of each of the ink channels 613 and the spaces 615 in such a manner that the nozzles 618 correspond to the ink channels 613, respectively. Further, the other end of each ink channel 613 is connected to the silicon chip 625, whereas the other end of each space 615 is connected to the ground 623.

In operation, when a voltage is applied from the silicon chip 625 to the electrodes 619 and 621 in each ink channel 613, each actuator wall 603 is deformed by a piezoelectric shear thickness effect in such a direction as to increase the volume of the ink channel 613. After a given period of time, the application of the voltage is stopped to restore an original volume of the ink channel 613 in its free condition from the increased volume. As a result, pressure is generated in the ink stored in the ink channel 613 to thereby eject droplets of the ink from the nozzle 618 corresponding to the ink channel 613.

In the ink ejecting apparatus 600 mentioned above, however, the upper ends of the lower wall parts 607 bonded to the bottom wall 601 are bonded to the lower ends of the upper wall parts 605 bonded to the top wall 602. Accordingly, in the process of bonding the upper wall parts 607 and the lower wall parts 605 together, it is very difficult to align both wall parts 607 and 605 requiring a great deal of time thereby reducing the effectiveness of mass production. Furthermore, each actuator wall 603 includes three bonding portions. Accordingly, when each actuator wall 603 is deformed, adhesive layers present at these bonding portions are deformed in a direction reversed to the direction of deformation of the upper wall part 605 and the lower wall part 607 constituting the actuator wall 603, causing a large energy loss at the bonding portions.

Further, in the ink ejecting apparatus 600 described above, the electrodes 619 and 621 disposed in the spaces 615 are connected to a ground 623, whereas the electrodes 619 and 621 disposed in the ink channels 613 are connected to a silicon chip 625 which provides an actuator for the driving circuits. However, a specific structure or method for the electric connection is not disclosed in the above-mentioned references. For example, if the ink ejecting apparatus 600 has fifty ink channels 613, fifty-one air channels 615 are required and it has one hundred and one electric connecting points between the electrodes 619 and 621 which have a quite a small pitch therebetween. Therefore, the electric connections between the electrodes 619 and 621 are difficult and therefore it takes time for the electric connecting process which results in a further reduction in the ability to mass produce.

SUMMARY OF THE INVENTION

It is accordingly an object of the invention to provide an ink ejecting apparatus which is superior in mass production and is low in energy loss.

It is another object of the invention to provide an ink ejecting apparatus capable of carrying out electric connection easily.

According to the invention, there is provided an ink ejecting apparatus comprising a plurality of ejecting channels from which ink is ejected; a plurality of non-ejecting regions from which the ink is not ejected, adjacent ones of the non-ejecting regions being arranged on opposite sides of each of the ejecting channels; a plurality of side walls separating the ejecting channels from the non-ejecting regions, the side walls being formed of piezoelectric ceramics polarized in one direction; and a plurality of electrodes for generating electric fields having a direction perpendicular to the direction of polarization of the side walls; wherein the ink is ejected from the ejecting channels by piezoelectric thickness shear deformation of the side walls.

In the ink ejecting apparatus having the above structure, the side walls formed of piezoelectric ceramics polarized in one direction separate the ejecting channels from the non-ejecting regions. The electric fields, having a direction perpendicular to the direction of polarization of the side walls, are generated from selected ones of the electrodes to thereby deform the corresponding side walls by a piezoelectric thickness shear effect and eject the ink from a desired one of the ejecting channels with no influence upon the other ejecting channels owing to the non-ejecting regions.

As is apparent from the above description, according to the ink ejecting apparatus of the invention, the side walls formed of piezoelectric ceramics polarized in one direction separate the ejecting channels from the non-ejecting regions. Accordingly, the ink ejecting apparatus can be constructed more easily than the conventional apparatus, thereby improving the mass productivity. Furthermore, since a bonding portion relating to each side wall is less in number than that in the conventional apparatus, the energy loss at the bonding portion can be reduced. In addition, since the non-ejecting regions are provided, the ink can be ejected from a desired one of the ejecting channels by the piezoelectric thickness shear deformation of the corresponding side walls with no influence upon the other ejecting channels, thereby improving the print quality.

BRIEF DESCRIPTION OF THE DRAWINGS

Preferred embodiments of the invention will be described in detail with reference to the following figures, wherein.

DETAILED DESCRIPTION OF THE PREFERRED EMBODIMENTS

Figure 1:
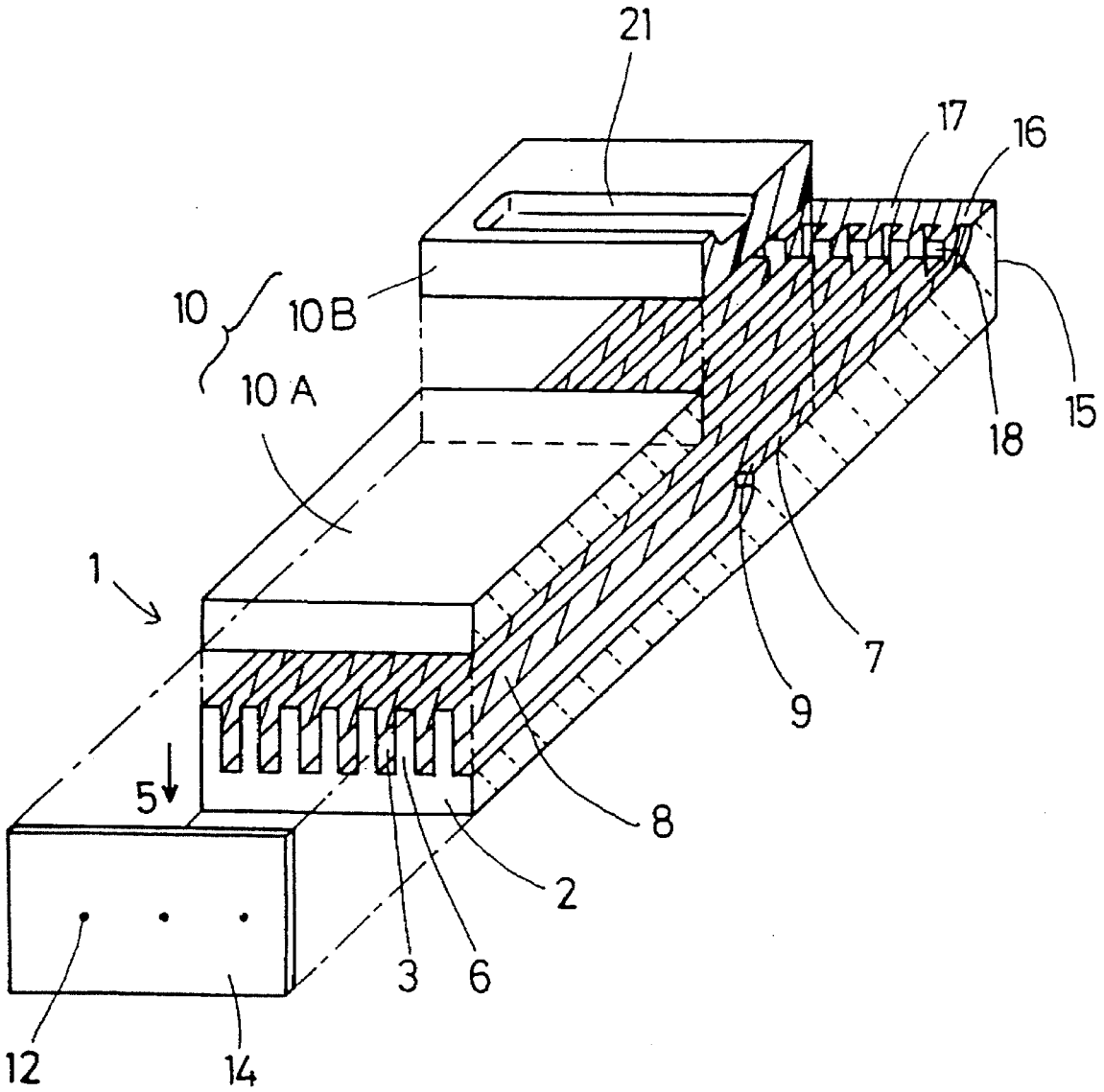
FIG. 1 is an exploded perspective view of an ink ejecting apparatus in a first preferred embodiment.
Figure 2A:
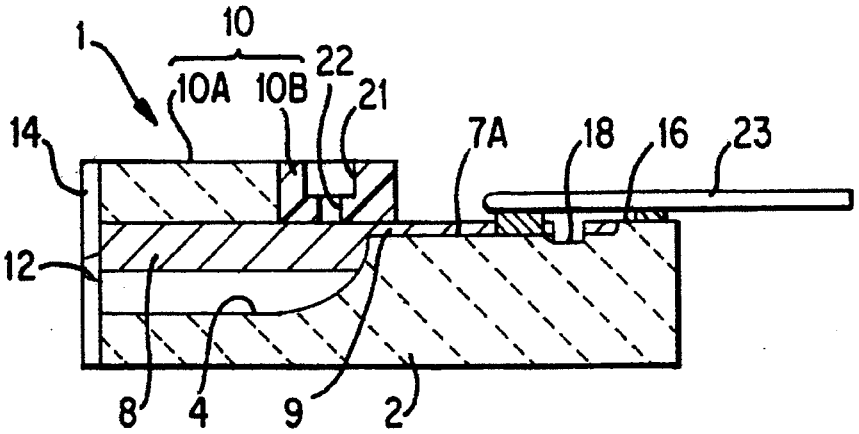
FIG. 2*a* is a sectional view of the ink ejecting apparatus shown in FIG. 1 illustrating the depths of the ink channel.
Figure 2B:
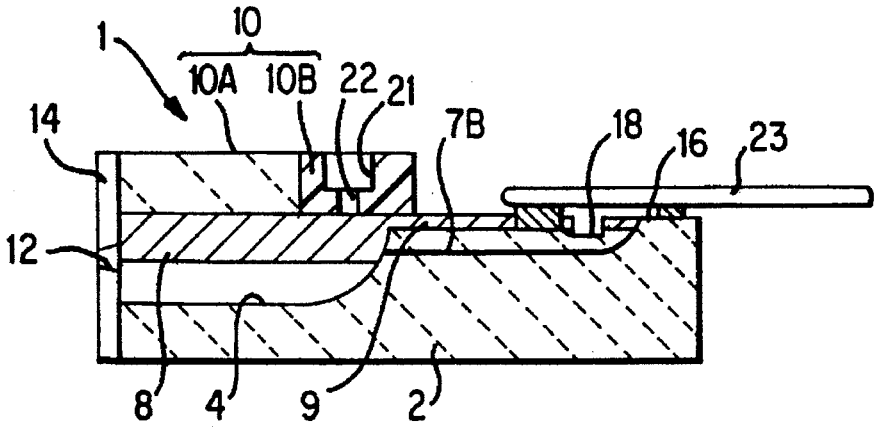
FIG. 2*b* is sectional view of ink ejection apparatus in FIG. 1 illustrating the depths of the air channel.

A first preferred embodiment of the invention will now be described with reference to FIGS. 1 to 9.

As shown in FIGS. 1, 2*a*, 2*b*, and 3, an ink ejecting apparatus 1 is composed of a piezoelectric ceramics plate 2, a cover plate 10, and a nozzle plate 14.

The piezoelectric ceramics plate 2 is formed of a ceramics material such as lead zirconate titanate (PZT). The piezoelectric ceramics plate 2 is provided with a plurality of grooves 3 by cutting using diamond blades or the like. A plurality of side walls 6, forming side surfaces of the grooves 3, are polarized in the direction shown by an arrow 5. All of the grooves 3 have the same depth and they are parallel to each other. The depth of the grooves 3 is gradually reduced as they approach a rear end surface 15 of the piezoelectric ceramics plate 2 to form a plurality of shallow grooves 7. An upper surface portion of the piezoelectric ceramics plate 2 near the rear end surface 15 is formed as a flat portion 16 without the shallow grooves 7. The shallow grooves 7 are divided into shallow grooves 7A and shallow grooves 7B deeper than the shallow grooves 7A. The shallow grooves 7A and the shallow grooves 7B are alternately arranged. The outermost two of the shallow grooves 7 are formed as the shallow grooves 7B.

A pair of metal electrodes 8 are formed on opposed side surfaces of each groove 3 at an upper half portion thereof by sputtering or the like. Further, a metal electrode 9 is formed on opposed side surfaces and a bottom surface of each shallow groove 7 by sputtering or the like. The pair of metal electrodes 8 formed on the opposed side surfaces of each groove 3 are electrically connected with the metal electrode 9 formed on the opposed side surfaces and the bottom surface of the corresponding shallow groove 7 contiguous to the groove 3. Further, a metal electrode 17 is formed on the flat portion 16. Accordingly, the metal electrodes 9 formed on the inside surfaces of all the shallow grooves 7 are electrically connected together by the metal electrode 17 formed on the flat portion 16. After forming the metal electrodes 8, 9, and 17, a separation groove 18 extending across the shallow grooves 7 is formed on the upper surface of the piezoelectric ceramics plate 2. The separation groove 18 is deeper than each shallow groove 7A and is shallower than each shallow groove 7B. Accordingly, the metal electrodes 9 in the shallow grooves 7A are made electrically independent of each other by the separation groove 18, whereas the metal electrodes 9 in the shallow grooves 7B are all electrically connected together. Further, an insulating layer (not shown) for insulating ink from each metal electrode 8 is formed on each metal electrode 8.

The cover plate 10 is composed of a front plate 10A formed of a ceramics material and a rear plate 10B formed of a resin material. Although the front plate 10A is formed of a ceramics material because it requires rigidity for effecting deformation of the side walls 6, the rear plate 10B may be formed of any material which is superior in formability and low in cost because it does not require rigidity. The front end surface of the rear plate 10B is bonded to the rear end surface of the front plate 10A. The rear plate 10B is formed with a plurality of ink inlet holes 22 and a manifold 21 communicating with the ink inlet holes 22.

Figure 5A:
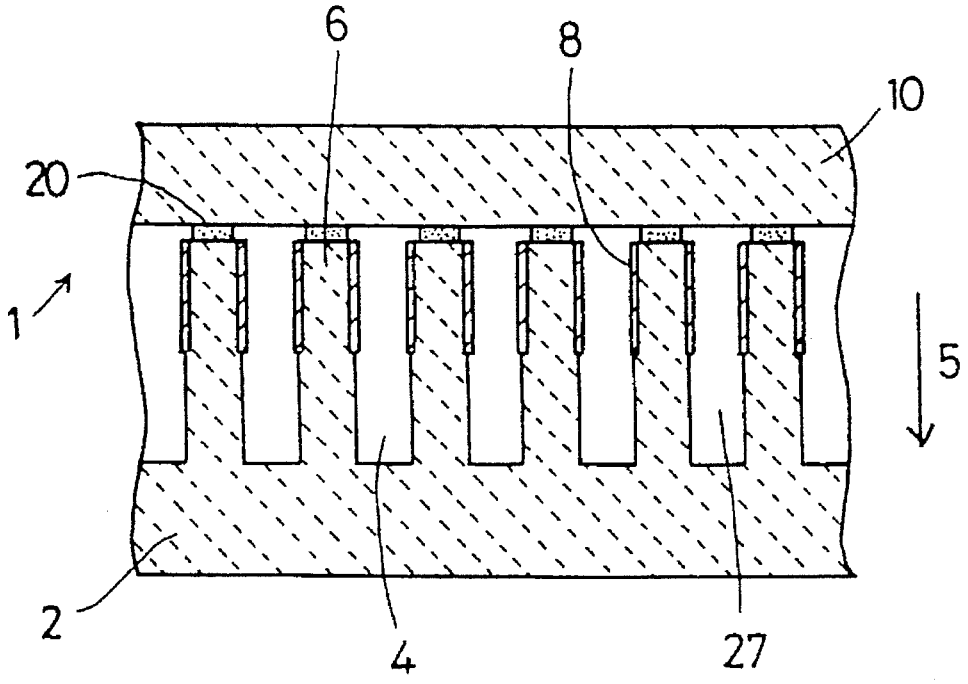
FIG. 5A is a sectional view of an essential part of the ink ejecting apparatus shown in FIG. 1, illustrating the condition before deformation of the side walls.

The lower surface of the cover plate 10 in which the ink inlet holes 22 are formed is bonded to the upper surface of the piezoelectric ceramics plate 2 in which the grooves 3 are formed by an epoxy adhesive 20 (see FIG. 5A). Accordingly, upper openings of the grooves 3 are covered with the cover plate 10 to define a plurality of ink chambers 4 as the ejecting channels communicating with the manifold 21 through the ink inlet holes 22 and a plurality of air chambers 27 as the non-ejecting regions not communicating with the manifold 21 (see FIG. 5A).

The ink chambers 4 correspond to the grooves 3 contiguous to the shallow grooves 7A, and the air chambers 27 correspond to the grooves 3 contiguous to the shallow grooves 7B. Each of the ink chambers 4 and the air chambers 27 is rectangular in vertical cross-section and is elongated in a longitudinal direction of the piezoelectric ceramics plate 2. All of the ink chambers 4 are filled with ink, and all the air chambers 27 are filled with air. In order to prevent leakage of the ink in the ink chambers 4 from the shallow groove 7A, an epoxy adhesive or the like (not shown) is provided near a joint portion between the shallow grooves 7 and the rear plate 10B of the cover plate 10.

The nozzle plate 14 is bonded to the front end surface of the assembly of the piezoelectric ceramics plate 2 and the cover plate 10. The nozzle plate 14 is provided with a plurality of nozzles 12 arranged at laterally spaced positions corresponding to the front end portions of the ink chambers 4. The nozzle plate 14 is formed of a plastic material such as polyalkylene (e.g., polyethylene) terephthalate, polyimide, polyetherimide, polyetherketone, polyethersulfone, polycarbonate, or cellulose acetate.

Figure 3:
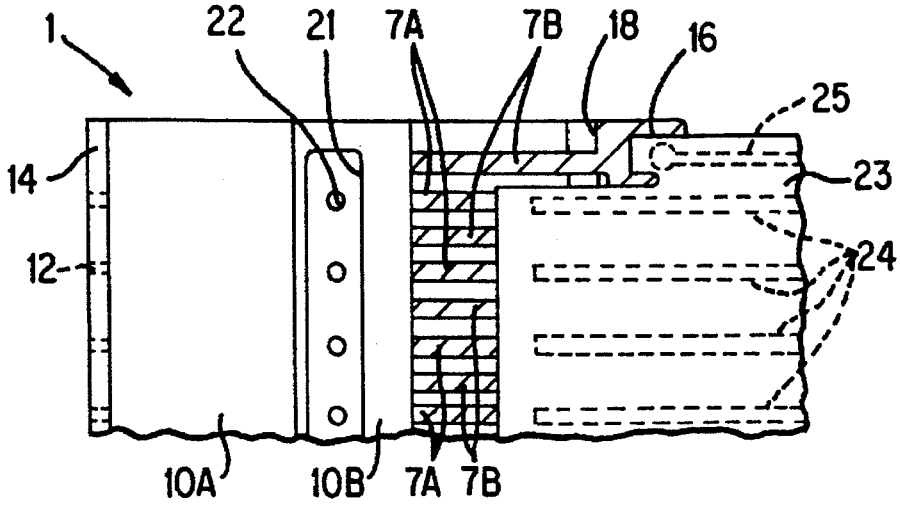
FIG. 3 is a partially cutaway plan view of the ink ejecting apparatus shown in FIG. 1.

As shown in FIG. 3, a plurality of patterns 24 formed on a flexible printed board 23 are connected to the metal electrodes 9 in the shallow grooves 7A and a pattern 25 formed on the flexible printed board 23 is connected to the metal electrode 17 on the flat portion 16. The patterns 24 are supplied with a voltage from a control section to be hereinafter described and the pattern 25 is grounded. All the patterns 24 and 25 on the flexible printed board 23 are connected to a rigid board (not shown) connected to the control section.

Figure 4:
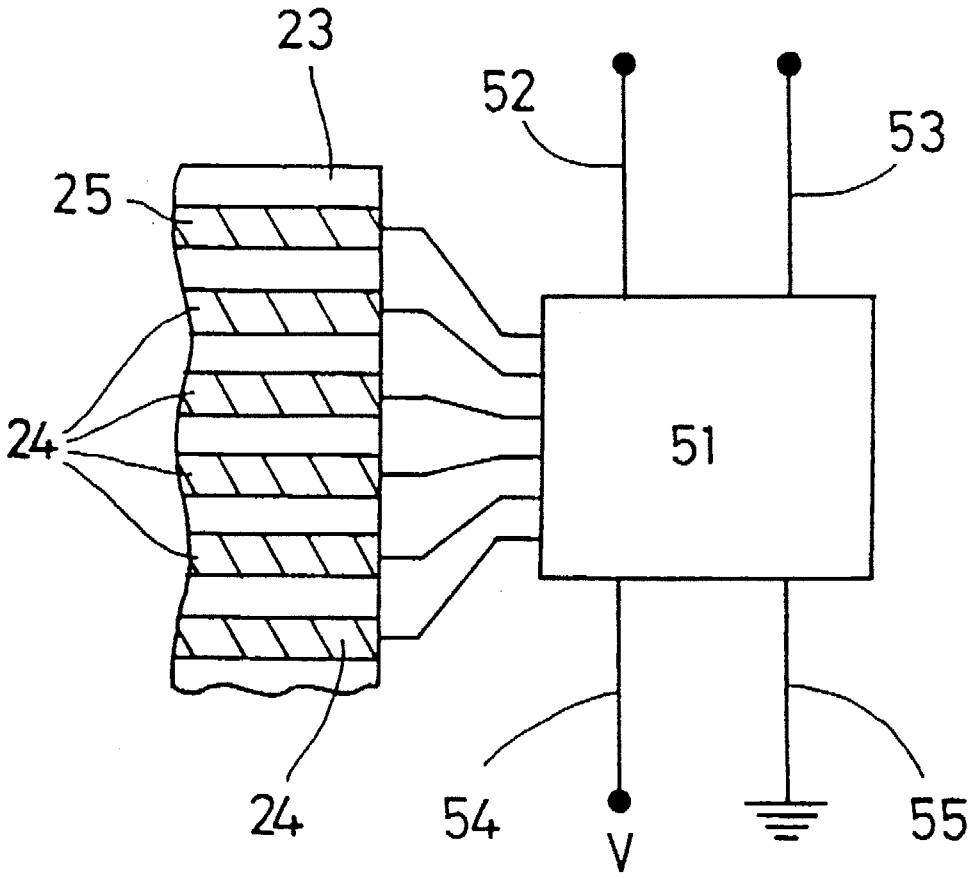
FIG. 4 is a schematic block diagram of a control section connected to the ink ejecting apparatus shown in FIG. 1.

Referring to FIG. 4, which is a block diagram of the control section, the patterns 24 and 25 are formed as conductor film patterns on the flexible printed board 23 and are individually connected through the rigid board to an LSI chip 51. Also connected to the LSI chip 51 are a clock line 52, a data line 53, a voltage line 54, and a ground line 55. The LSI chip 51 determines from which nozzle 12 the ink droplets are to be ejected according to data appearing on the data line 53 on the basis of continuous clock pulses supplied from the clock line 52.

Then, according to the result of the determination, the LSI chip 51 applies a voltage V from the voltage line 54 to the conductor film pattern 24, connected to the metal electrodes 8 in the ink chamber 4 to be driven. Further, the LSI chip 51 connects to the ground line 55 the other conductor film patterns 24 connected to the metal electrodes 8 in the other ink chambers 4 not to be driven, and the conductor film pattern 25 connected to the metal electrodes 8 in the air chambers 27.

Figure 5B:
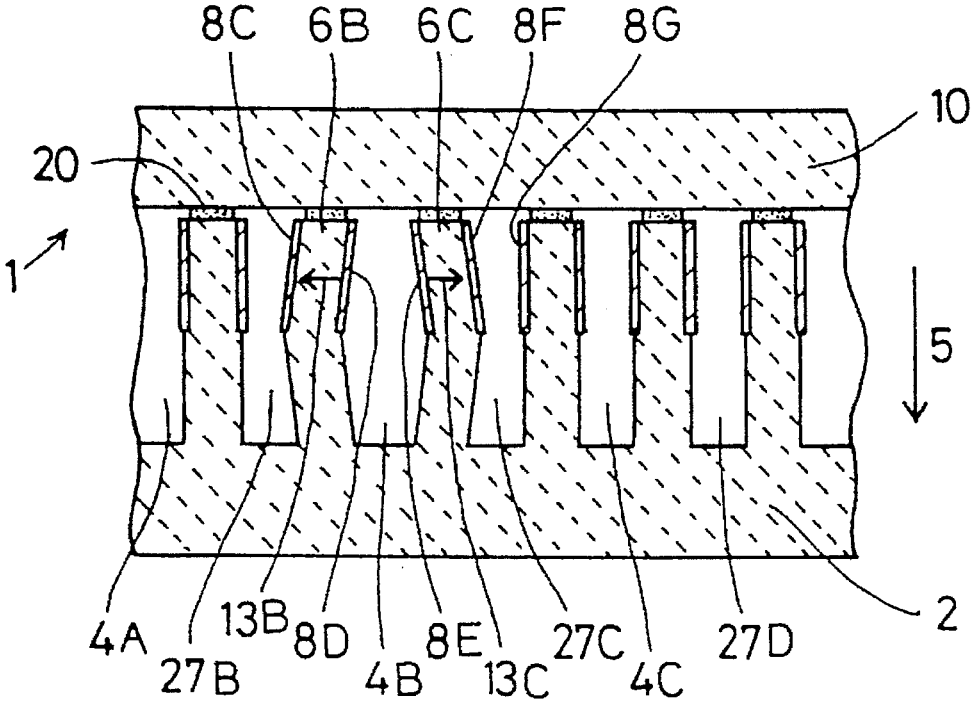
FIG. 5B is a sectional view similar to FIG. 5A, illustrating the condition after deformation of the side walls.

The operation of the ink ejecting apparatus 1 in the first preferred embodiment will now be described. Referring to FIG. 5B, a voltage pulse is applied to the ink chamber 4B in order to eject the ink droplets from the ink chamber 4B (the application of a voltage to a designated one of the ink chambers 4 means to apply the voltage to the metal electrodes 8 formed in the designated ink chamber 4 and to ground both the metal electrodes 8 formed in the other ink chambers 4 not designated and the metal electrodes 8 formed in the air chambers 27). In this case, the voltage is applied to the metal electrodes 8D and 8E formed in the ink chamber 4B. Accordingly, an electric field, having a direction 13B, is generated in the side wall 6B, and an electric field, having a direction 13C, is generated in the side wall 6C so that the side walls 6B and 6C are deformed to deflect away from each other. As a result, the volume of the ink chamber 4B is increased to reduce the pressure in the ink chamber 4B including a portion near the corresponding nozzle 12 communicating therewith. This condition is maintained for a time period L/a (where L represents the length of each ink chamber 4 and a represents the sound velocity in the ink). During this time period, additional ink is supplied from an ink supply source (not shown) through the manifold 21 and the corresponding ink inlet hole 22 into the ink chamber 4B. The time period L/a is the time required for the one-way propagation of a pressure wave generated in the ink stored in the ink chamber 4B in the longitudinal direction of the ink chamber 4B (i.e., from the ink inlet hole 22 to the nozzle plate 14 or vice versa). This value depends on the length L of the ink chamber 4B and the sound velocity a in the ink.

According to the propagation theory of a pressure wave, when the time L/a has elapsed after generation of the pressure wave, the pressure in the ink chamber 4B is inverted to a positive pressure. In concert with this timing, the voltage applied to the metal electrodes 8D and 8E in the ink chamber 4B is cut to restore 0 V. As a result, the side walls 6B and 6C are returned to an original condition before the deformation (see FIG. 5A), thereby applying a pressure to the ink in the ink chamber 4B. At this time, the positive pressure mentioned above and the pressure generated by the return of the side walls 6B and 6C to the original condition before the deformation combine to produce a relatively high pressure which is applied to the ink in the ink chamber 4B to eject the ink droplets from the corresponding nozzle 12.

In the first preferred embodiment, the ink droplets are ejected from the ink chamber 4B by first applying a driving voltage to the ink chamber 4B in such a direction as to increase the volume of the ink chamber 4B and then stopping the application of the driving voltage to reduce the volume of the ink chamber 4B to its free condition. Alternatively, a driving voltage may be first applied to the ink chamber 4B in its free condition so as to reduce the volume of the ink chamber 4B, thereby ejecting the ink droplets from the ink chamber 4B. Then, the application of the driving voltage is stopped to thereby increase the volume of the ink chamber 4B from the reduced condition to the free condition, thereby supplying additional ink into the ink chamber 4B.

As described above, in the ink ejecting apparatus 1 in the first preferred embodiment, the side walls 6 are formed by forming the grooves 3 on the single piezoelectric ceramics plate 2 by cutting. The ink chambers 4 and the air chambers 27 are formed by bonding the cover plate 10 using the adhesive 20 to the tops of the side walls 6. Thus, the ink ejecting apparatus 1 can be constructed more easily than the conventional apparatus to improve mass production. Further, since each side wall 6 is bonded at one portion to the cover plate 10, the energy loss at the bonding portion is less than that in the conventional apparatus. Further, since the air chambers 27 are filled with air, the side walls 6 can be easily deformed by a low driving voltage.

Further, since the ink inlet holes 22, formed through the rear plate 10B of the cover plate 10, communicate with only the ink chambers 4 in this preferred embodiment, no ink is supplied to the air chambers 27. Accordingly, the deformation of the side walls 6B and 6C for ejecting the ink droplets from the ink chamber 4B has no influence upon other ink chambers 4A and 4C near the ink chamber 4B. Accordingly, the ink droplets can be well ejected from each ink chamber 4 to thereby improve the print quality.

Figure 6:
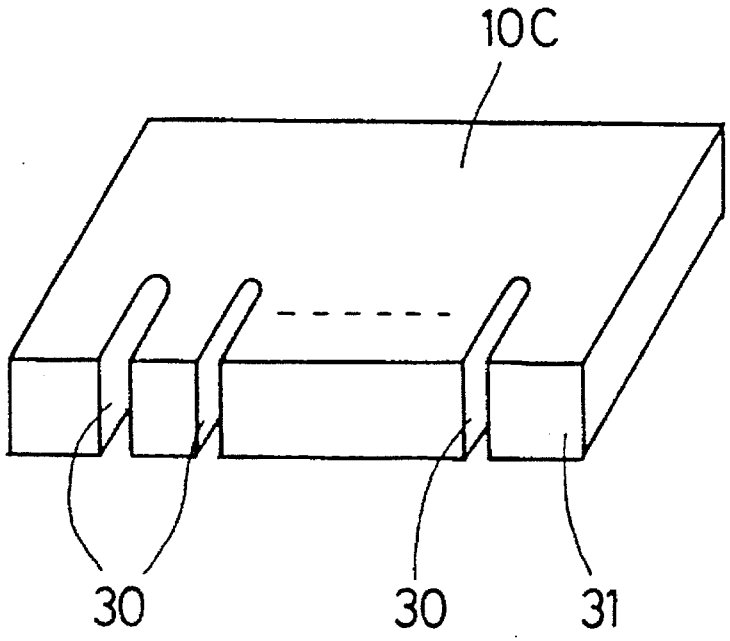
FIG. 6 is a perspective view of a modification of a rear plate of the ink ejecting apparatus in the first preferred embodiment.

Although the rear plate 10B of the cover plate 10 is provided with the ink inlet holes 22 communicating with only the ink chambers 4 in this preferred embodiment, the rear plate 10B may be replaced by a rear plate 10C shown in FIG. 6. The rear plate 10C is provided with a plurality of slits 30 communicating with only the ink chambers 4. An end surface 31 of the rear plate 10C on which the slits 30 are formed is bonded to the rear end surface of the front plate 10A. Further, although the rear plate 10B of the cover plate 10 is formed of a resin material in the first preferred embodiment, the rear plate 10B may be formed of photosensitive glass that is easily worked to form a plurality of through holes at a small pitch. Further, although the cover plate 10 is composed of two members, i.e., the front plate 10A and the rear plate 10B in the first preferred embodiment, the cover plate 10 may be formed as a single member from a ceramics material or the like.

Further, in the ink ejecting apparatus 1 in the first preferred embodiment, the metal electrodes 9 in the shallow grooves 7A of the ink chambers 4 are made electrically independent of each other by the separation grooves 18, and the metal electrodes 8 in all of the air chambers 27 are electrically connected together by the metal electrodes 9 in the shallow grooves 7B and the metal electrode 17 on the flat portion 16. Thus, an electrical connection means for grounding the metal electrodes 8 in all the air chambers 27 can be formed in at least one position. Accordingly, all the metal electrodes 8 in the ink chambers 4 and the air chambers 27 can be easily connected respectively to the patterns 24 and 25 formed on the flexible printed board 23 connected to the LSI chip 51.

Figure 7:
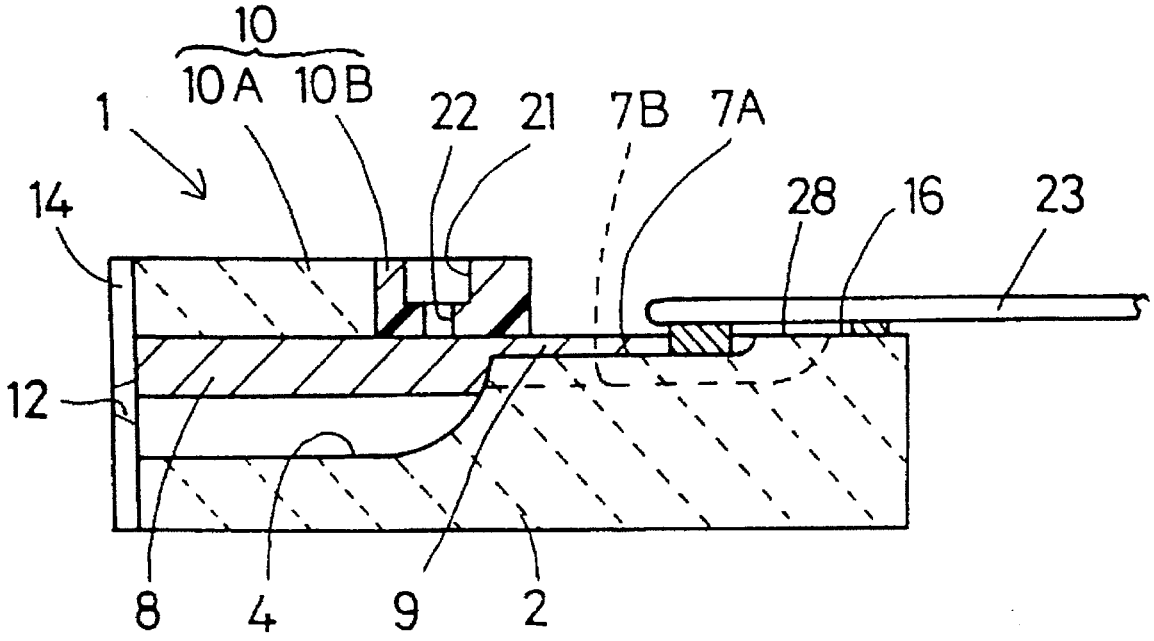
FIG. 7 is a sectional view of a modification of the ink ejecting apparatus in the first preferred embodiment, illustrating another manner of electrode connection.

Although the separation groove 18 is formed after forming the metal electrodes 8, 9, and 17 in the first preferred embodiment, this structure may be replaced by the structure shown in FIG. 7. That is, the length of each shallow groove 7A is set shorter than that of each shallow groove 7B, and an intermediate portion 28 is formed between the shallow grooves 7A and the flat portion 16. No metal electrodes are formed on the intermediate portion 28 to thereby make the metal electrodes 9 in the shallow grooves 7A of the ink chambers 4 electrically independent of each other. On the other hand, the metal electrodes 9 in the shallow grooves 7B of all the air chambers 27 are electrically connected together by the metal electrode 17 on the flat portion 16. In this case, the depth of each shallow groove 7A may be set equal to the depth of each shallow groove 7B. Also in this case, an electrical connection means for grounding the metal electrodes 8 in all the air chambers 27 can be formed in at least one position so that all the metal electrodes 8 in the ink chambers 4 and the air chambers 27 can be easily connected respectively to the patterns 24 and 25 formed on the flexible printed board 23 connected to the LSI chip 51.

Figure 8:
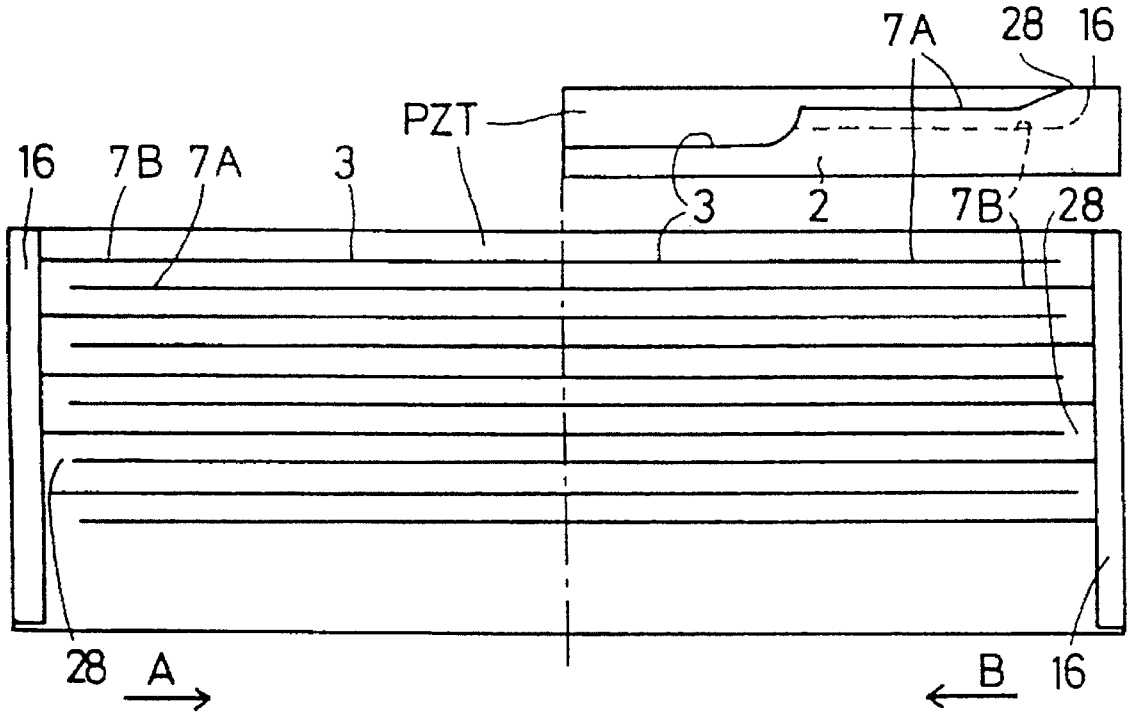
FIG. 8 is an illustration of a forming method for a piezoelectric ceramics plate of the ink ejecting apparatus shown in FIG. 7.

The grooves 3 and the shallow grooves 7A and 7B shown in FIG. 7 are formed in the manner shown in FIG. 8. A single stock plate of a piezoelectric ceramics material having a length twice that of the piezoelectric ceramics plate 2 is prepared. A plurality of diamond blades are moved in a leftward direction shown by an arrow B from the right-hand side as viewed in FIG. 8 to cut the upper surface of the stock plate, thereby first forming the shallow grooves 7A at the right-hand end portion of the stock plate with the flat portion 16 and the intermediate portion 28 left. As the movement of the diamond blades proceeds, the depth of cut is increased to thereby form the grooves 3, and thereafter the depth of cut is decreased to thereby form the shallow grooves 7B on the left-hand end portion of the stock plate with the flat portion 16 left. In the next step, the diamond blades are moved in a rightward direction shown by an arrow A from the left-hand side as viewed in FIG. 8 to cut the upper surface of the stock plate in such a manner that each diamond blade passes between the adjacent grooves 3 previously formed, thereby first forming the shallow grooves 7A at the left-hand end portion of the stock plate with the flat portion 16 and the intermediate portion 28 left, secondly forming the grooves 3, and finally forming the shallow grooves 7B with the flat portion 16 left at the right-hand end of the stock plate. Finally, the stock plate is cut at the center (shown by a dot-dashed line) to obtain two piezoelectric ceramics plates 2 having the same structure. Alternatively, a single diamond blade may be used to form each groove.

Figure 9:
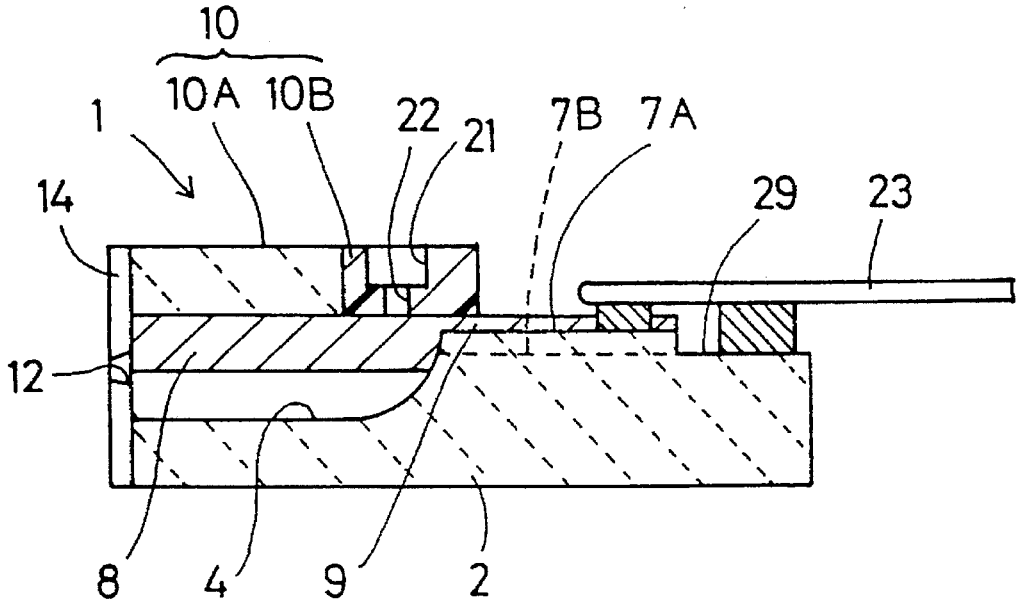
FIG. 9 is a sectional view of another modification of the ink ejecting apparatus in the first preferred embodiment, illustrating still another manner of electrode connection.

The flat portion 16 and the intermediate portion 28 shown in FIG. 7 may be replaced by a cutaway portion 29 shown in FIG. 9. That is, as shown in FIG. 9, the cutaway portion 29 is formed on the upper surface of the piezoelectric ceramics plate 2 near the rear end surface 15 thereof. The depth of the cutaway portion 29 is equal to that of each shallow groove 7B. The metal electrodes 8 are formed in the grooves 3; the metal electrodes 9 are formed in the shallow grooves 7A and 7B; and a metal electrode is formed on the cutaway portion 29. Accordingly, the metal electrodes 9 in the shallow grooves 7A of all the ink chambers 4 are electrically independent of each other, and the metal electrodes 9 in the shallow grooves 7B of all the air chambers 27 are electrically connected together by the metal electrode formed on the cutaway portion 29. Also in this case, an electrical connection means for grounding the metal electrodes 8 in all of the air chambers 27 can be formed in at least one position so that all the metal electrodes 8 in the ink chambers 4 and the air chambers 27 can be easily connected respectively to the patterns 24 and 25 formed on the flexible printed board 23 connected to the LSI chip 51.

Further, in the structure shown in FIG. 9, there is no possibility that a cover member of the flexible printed board 23 for covering the patterns 24 and 25 may interfere with the flat portion 16 (FIG. 1) to cause a defective connection between the metal electrodes 9 in the shallow grooves 7A and the patterns 24. Although the depth of the cutaway portion 29 is set equal to that of each second shallow groove 7B in this embodiment, this setting is not essential but it is only necessary to set the depth of the cutaway portion 29 greater than the depth of each shallow groove 7A.

Although the metal electrode for electrically connecting the metal electrodes 9 in all the shallow grooves 7B is formed on the piezoelectric ceramics plate 2 according to each electrical connection structure shown in FIGS. 2*a*, 2*b*, 7, and 9, a pattern for electrically connecting the metal electrodes 9 in all the shallow grooves 7B may be formed on the flexible printed board 23 rather than forming the electrically connecting metal electrode on the piezoelectric ceramics plate 2.

Further, the width of each air chamber 27 may be set smaller than the width of each ink chamber 4, thereby reducing the width of the piezoelectric ceramics plate 2.

A second preferred embodiment of the invention will now be described with reference to FIGS. 10 to 12B, in which the same parts as those in the first preferred embodiment will be denoted by the same reference numerals and the explanation thereof will be omitted.

Figure 10:
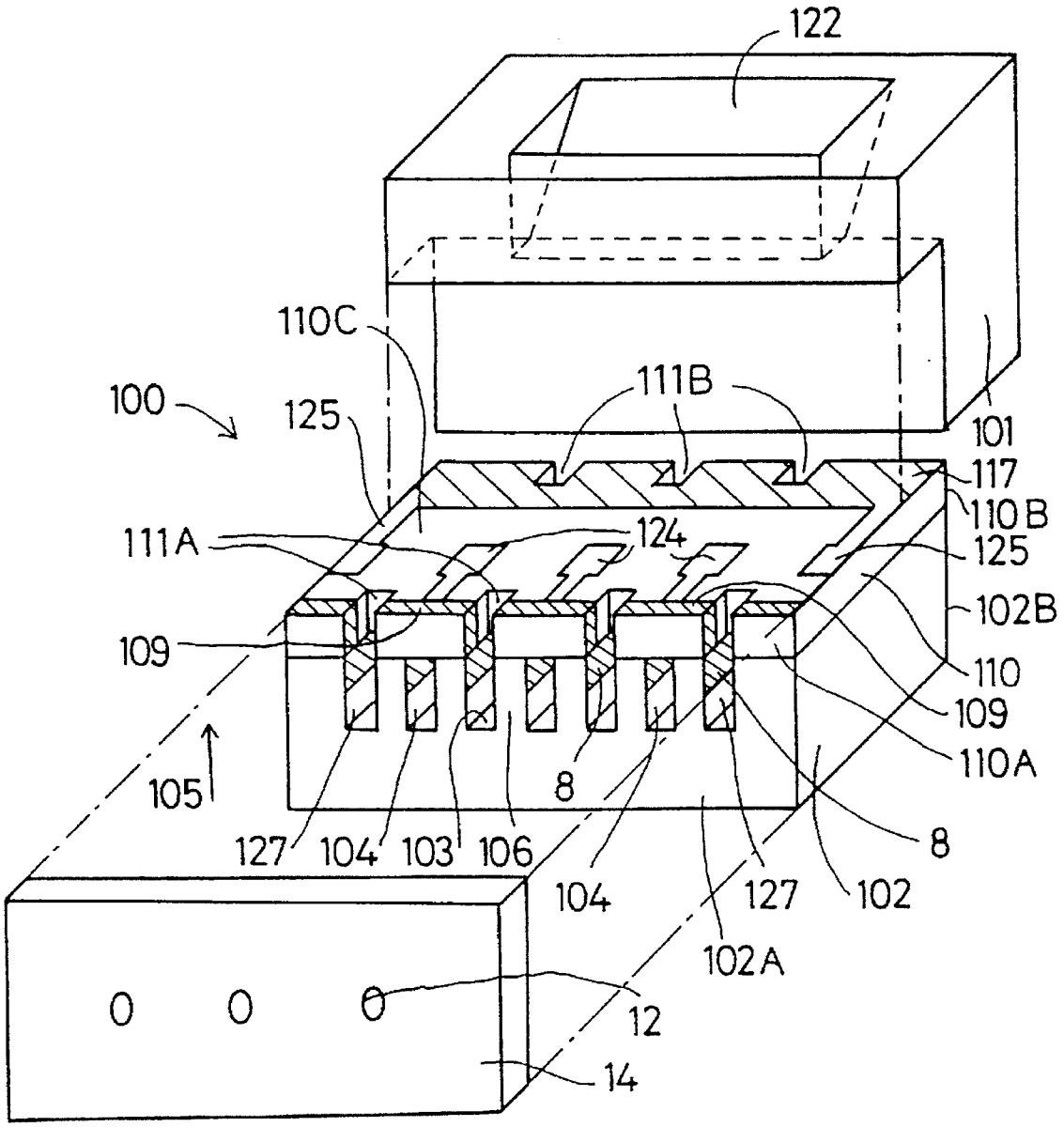
FIG. 10 is an exploded perspective view of an ink ejecting apparatus in a second preferred embodiment according to the invention.

As shown in FIG. 10, an ink ejecting apparatus 100 is composed of a piezoelectric ceramics plate 102, a cover plate 110, a nozzle plate 14, and a manifold member 101.

The piezoelectric ceramics plate 102 is formed of a ceramics material such as lead zirconate titanate (PZT). The piezoelectric ceramics plate 102 is provided with a plurality of grooves 103 by cutting using diamond blades or the like. A plurality of side walls 106 forming side surfaces of the grooves 103 are polarized in a direction shown by an arrow 105. All the grooves 103 have the same depth, and they are parallel to each other so as to extend over the length of the piezoelectric ceramics plate 102 and open to opposite end surfaces 102A and 102B of the piezoelectric ceramics plate 102. A pair of metal electrodes 8 are formed on opposed side surfaces of each groove 103 at an upper half portion thereof by sputtering or the like.

The cover plate 110 is formed of alumina and opposite end surfaces 110A and 110B of the cover plate 110 are provided with a plurality of slits 111A and a plurality of slits 111B, respectively. The slits 111A are arranged at a pitch twice that of the grooves 103, and the slits 111B are arranged at the same pitch as that of the slits 111A. However, the slits 111B are shifted by the half pitch from the slits 111A. The outermost two of the slits 111A correspond to the outermost two of the grooves 103. Further, a plurality of patterns 124 and 125 are formed on an upper surface 110C of the cover plate 110.

Figure 12A:
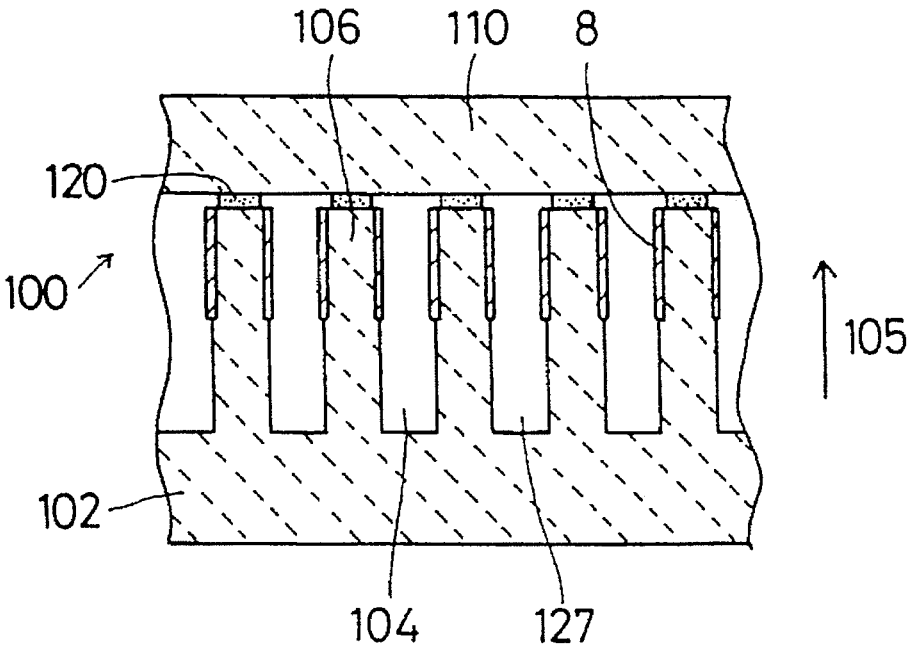
FIG. 12A is a sectional view of an essential part of the ink ejecting apparatus shown in FIG. 10, illustrating the condition before deformation of side walls.

The lower surface of the cover plate 110 on the opposite side of the upper surface 110C is bonded to the upper surface of the piezoelectric ceramics plate 102, in which the grooves 103 are formed, by an epoxy adhesive 120 (see FIG. 12A). Accordingly, the upper openings of the grooves 103 are covered with the cover plate 110 to define a plurality of ink chambers 104 as the ejecting channels communicating with the slits 111B and a plurality of air chambers 127 as the non-ejecting regions communicating with the slits 111A. Each of the ink chambers 104 and the air chambers 127 is rectangular in vertical cross-section and is elongated in a longitudinal direction of the piezoelectric ceramics plate 102. All the ink chambers 104 are filled with ink and all the air chambers 127 are filled with air.

After bonding the cover plate 110 to the piezoelectric ceramics plate 102, a plurality of metal electrodes 109 are formed by sputtering or the like on the upper surface 110C of the cover plate 110 at a front end portion thereof between the bottom surfaces of the slits 111A and the front end surface 110A of the cover plate 110 and on a part of the opposed side surfaces of the slits 111A. The metal electrodes 109 formed on the opposed side surfaces of the slits 111A overlap the metal electrodes 8 formed in the air chambers 127 communicating with the slits 111A, thereby obtaining electrical connection between the metal electrodes 109 and the metal electrodes 8 in the air chambers 127.

Accordingly, the metal electrode 8 formed on one side surface of the side wall 6 exposed to each air chamber 127 is electrically connected by the corresponding metal electrode 109 to the metal electrode 8 formed on one side surface of the side wall 6 exposed to another air chamber 127 adjacent to the air chamber 127 with the ink chamber 104 defined by both side walls 6. Further, the metal electrodes 109 are individually electrically connected to the patterns 124.

A metal electrode 117 is formed on the upper surface 110C of the cover plate 110 at a rear portion thereof between the center and the rear end surface 110B of the cover plate 110 and on the whole of the opposed side surfaces of the slits 111B. The metal electrode 117 formed on the opposed side surfaces of the slits 111B overlaps the metal electrodes 8 formed in the ink chambers 104 communicating with the slits 111B, thereby obtaining electrical connection between the metal electrode 117 and the metal electrodes 8 in the ink chambers 104. In other words, the metal electrodes 8 in all the ink chambers 104 are electrically connected together by the metal electrode 117. Further, the metal electrode 117 is electrically connected to the patterns 125. In forming the metal electrodes 109 and 117, mask members are provided on the end surfaces 102A and 102B of the piezoelectric ceramics plate 102 and on the end surfaces 110A and 110B of the cover plate 110.

The nozzle plate 14 is bonded to the front end surface 102A of the piezoelectric ceramics plate 102 and the front end surface 110A of the cover plate 110. The nozzle plate 14 is provided with a plurality of nozzles 12 arranged at laterally spaced positions corresponding to the front end positions of the ink chambers 104. The nozzle plate 14 is formed of a plastic material such as polyalkylene (e.g., polyethylene) terephthalate, polyimide, polyetherimide, polyetherketone, polyethersulfone, polycarbonate, or cellulose acetate.

The manifold member 101 is bonded to the rear end surface 102B of the piezoelectric ceramics plate 102, the rear end surface 110B of the cover plate 110, and the upper surface 110C of the cover plate 110 at the rear end portion. The manifold member 101 is provided with a manifold 122 communicating at a lower end thereof with all the slits 111B.

The patterns 124 and 125 formed on the cover plate 110 are connected to a plurality of wiring patterns (not shown) formed on a flexible printed board (not shown). The wiring patterns on the flexible printed board are connected to a rigid board (not shown) connected to a control section which will be next described.

Figure 11:
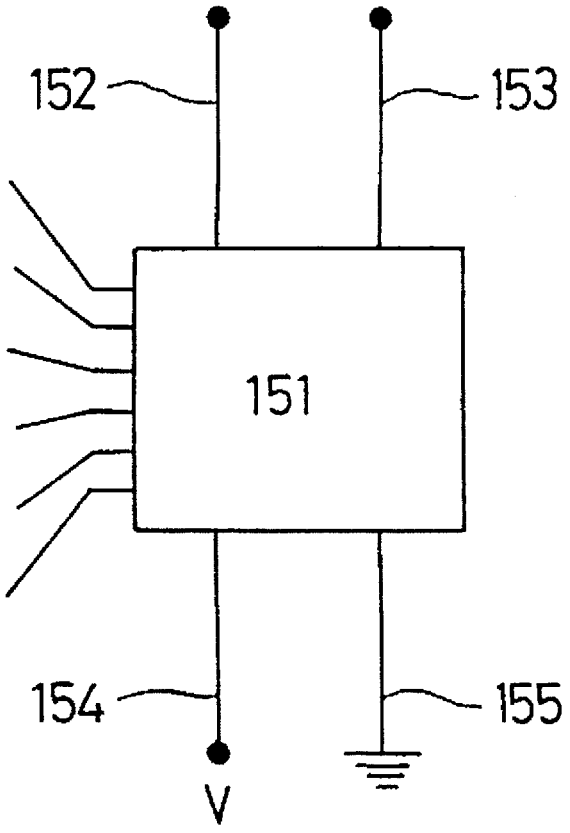
FIG. 11 is a schematic block diagram of a control section connected to the ink ejecting apparatus shown in FIG. 10.

Referring to FIG. 11, which is a block diagram of the control section, the patterns 124 and 125 formed as conductor film patterns on the cover plate 110 are individually connected through the flexible printed board and the rigid board to an LSI chip 151. Also connected to the LSI chip 151 are a clock line 152, a data line 153, a voltage line 154, and a ground line 155. The LSI chip 151 determines which nozzle 12 the ink droplets are to be ejected from according to data appearing on the data line 153 on the basis of continuous clock pulses supplied from the clock line 152. Then, according to the result of the determination, the LSI chip 151 applies a voltage V from the voltage line 154 to the conductor film pattern 124 connected to the metal electrodes 8 in the two air chambers 127 on both sides of the ink chamber 4 from which the ink droplets are to be ejected. Further, the LSI chip 151 connects to the ground line 155 the other conductor film patterns 124 connected to the metal electrodes 8 in the other air chambers 127 and the conductor film patterns 125 connected to the metal electrodes 8 in all the ink chambers 104.

Figure 12B:
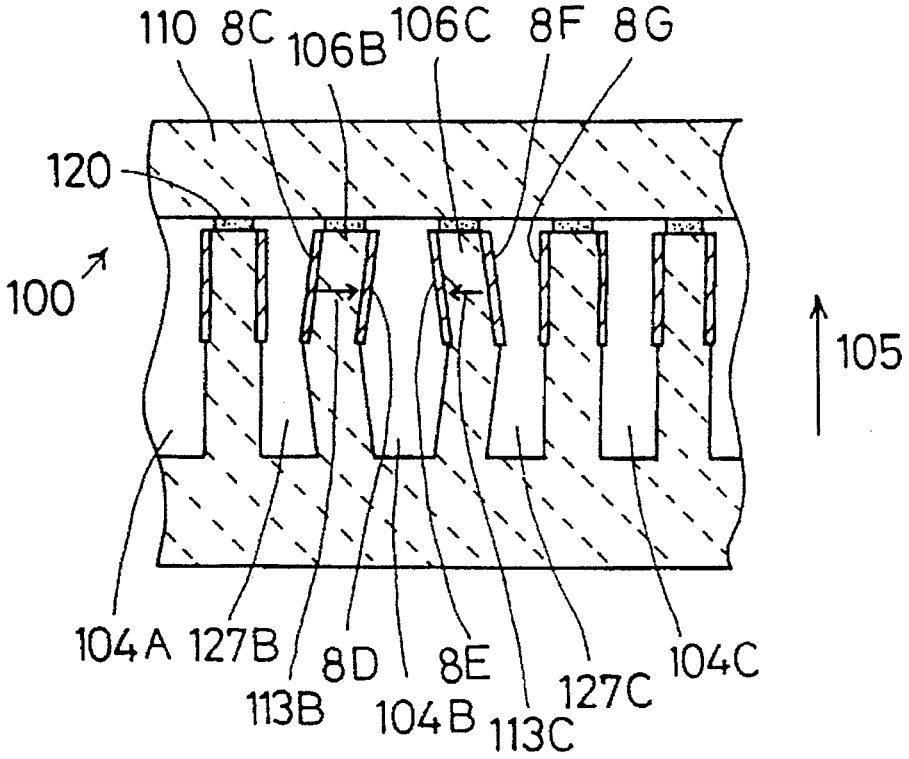
FIG. 12B is a sectional view similar to FIG. 12A, illustrating the condition after deformation of the side walls.
Figure 13A:
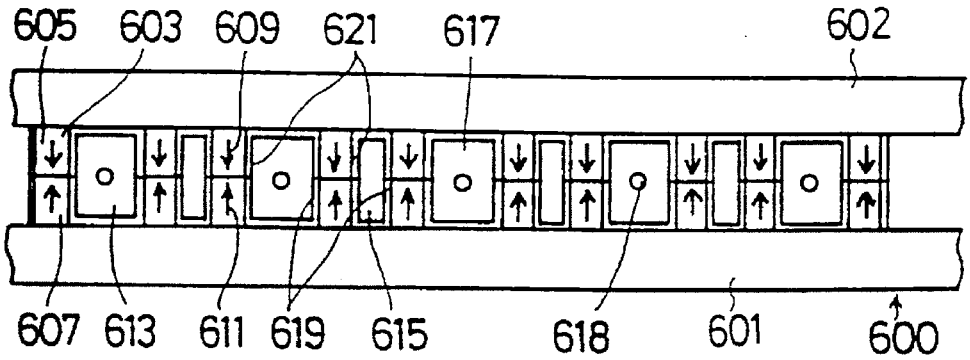
Fig.13A RELATED ART
FIG. 13A is a sectional end elevation of an ink ejecting apparatus in the related art.
Figure 13B:
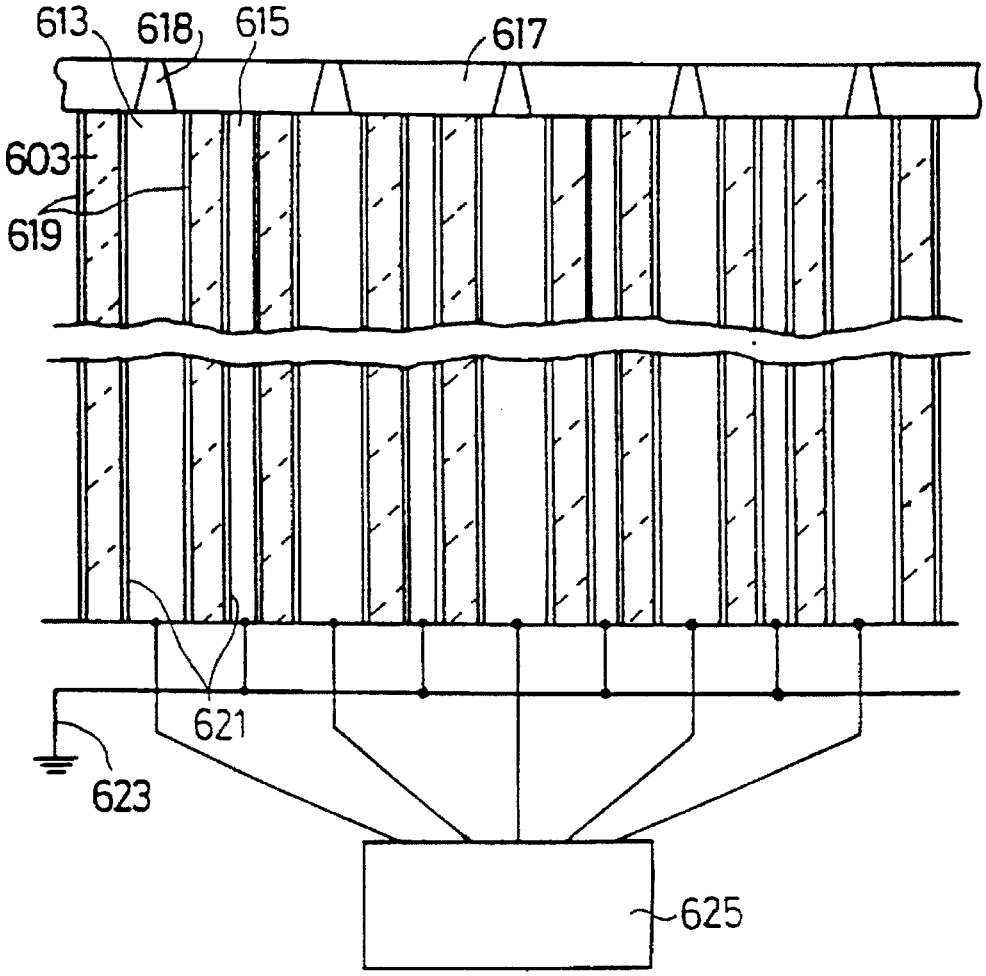
Fig.13B RELATED ART
FIG. 13B is a sectional plan view of the ink ejecting apparatus shown in FIG. 13A.

The operation of the ink ejecting apparatus 100 in the second preferred embodiment will now be described. Referring to FIG. 12B, a voltage pulse is applied to the metal electrodes 8C and 8F in the air chambers 127B and 127C on both sides of the ink chamber 104B through the pattern 124 connected to the metal electrodes 8C and 8F in order to eject the ink droplets from the ink chamber 104B. The other metal electrodes 8 are all grounded through the other patterns 124 and the patterns 125. Accordingly, an electric field having a direction 113B is generated in the side wall 106B, and an electric field having a direction 113C is generated in the side wall 106C, so that the side walls 106B and 106C are deformed so as to deflect away from each other. As a result, the volume of the ink chamber 104B is increased to reduce the pressure in the ink chamber 104B including a portion near the corresponding nozzle 12 communicating therewith. This condition is maintained for a time period L/a (where L represents the length of each ink chamber 104 and a represents the sound velocity in the ink). During this time period, additional ink is supplied from an ink supply source (not shown) through the manifold 122 and the corresponding slit 111B into the ink chamber 104B. The time period L/a is the time required for one-way propagation of a pressure wave generated in the ink stored in the ink chamber 104B in the longitudinal direction of the ink chamber 104B (i.e., from the slit 111B to the nozzle plate 14 or vice versa). The value depends on the length L of the ink chamber 104B and the sound velocity a in the ink.

According to the propagation theory of a pressure wave, when the time L/a has elapsed after generation of the pressure wave, the pressure in the ink chamber 104B is inverted to a positive pressure. In concert with this timing, the voltage applied to the metal electrodes 8C and 8F is cut to restore 0 V. As a result, the side walls 106B and 106C are returned to their original condition before the deformation (see FIG. 12A), thereby applying a pressure to the ink in the ink chamber 104B. At this time, the positive pressure described above and the pressure generated by the return of the side walls 106B and 106C to the original condition before the deformation are combined to produce a relatively high pressure. The relatively high pressure is applied to the ink in the ink chamber 104B to eject the ink droplets from the corresponding nozzle 12.

In the second preferred embodiment, the ink droplets are ejected from the ink chamber 104B by first applying a driving voltage to the metal electrodes 8C and 8F in such a direction as to increase the volume of the ink chamber 104B and then stopping the application of the driving voltage to reduce the volume of the ink chamber 104B to its free condition. Alternatively, a driving voltage may be first applied to metal electrodes 8C and 8F in the free condition of the ink chamber 104B so as to reduce the volume of the ink chamber 104B thereby ejecting the ink droplets from the ink chamber 104B. Then, the application of the driving voltage is stopped to thereby increase the volume of the ink chamber 104B from the reduced condition to the free condition, thereby supplying additional ink into the ink chamber 104B.

As described above, in the ink ejecting apparatus 100 in the second preferred embodiment, the side walls 106 are formed by forming the grooves 3 on the single piezoelectric ceramics plate 102 by cutting and the ink chambers 104 and the air chambers 127 are formed by bonding the cover plate 110 through the adhesive 120 to the tops of the side walls 106. Thus, the ink ejecting apparatus 100 can be constructed more easily than the conventional apparatus resulting in improved mass production. Further, since each side wall 106 is bonded at one portion to the cover plate 110, the energy loss at the bonding portion is less than that in the conventional apparatus. Further, since the air chambers 127 are filled with air, the side walls 106 can be easily deformed by a low driving voltage.

Further, since the slits 111B formed on the rear end surface 110B of the cover plate 110 communicate with only the ink chambers 104 in this preferred embodiment, only the ink chambers 104 are in communication with the manifold 122 through the slits 111B. The air chambers 127 are not in communication with the manifold 122. Accordingly, no ink is supplied to the air chambers 127 and the deformation of the side walls 106B and 106C for ejecting the ink droplets from the ink chamber 104B has no influence upon other ink chambers 104A and 104C near the ink chamber 104B. Accordingly, the ink droplets can be well ejected from each ink chamber 104 to thereby improve the print quality.

Further, in the second preferred embodiment, a voltage pulse is applied to the metal electrodes 8C and 8F in the air chambers 127B and 127C on both sides of the designated ink chamber 104B through the pattern 124 connected to the metal electrodes 8C and 8F, and the other metal electrodes 8 are all grounded, through the other patterns 124 and the patterns 125, thereby ejecting the ink droplets from the nozzle 12 communicating with the designated ink chamber 104B. In other words, no voltage is applied to the metal electrodes 8 in all the ink chambers 104, thereby suppressing deterioration of the metal electrodes 8. Accordingly, it is unnecessary to form an insulating layer for insulating the ink from the metal electrodes 8 as in the conventional apparatus, thereby eliminating the need of installation and the process for forming the insulating layer to improve the productivity and reduce the cost. Furthermore, since no voltage is applied to the metal electrodes 8 in the ink chambers 104 filled with the ink, the corrosion resistance of the used metal electrodes 8 can be improved so that the life of the metal electrodes 8 can be extended and the life of the ink ejecting apparatus 100 can therefore be extended.

Further, in the ink ejecting apparatus 100 in the second preferred embodiment, after bonding the cover plate 110 to the piezoelectric ceramics plate 102, the metal electrodes 109 are formed on the upper surface 110C of the cover plate 110 at the front end portion between the bottom surfaces of the slits 111A and the front end surface 110A and on a part of the opposed side surfaces of the slits 111A. Accordingly, the metal electrode 8 formed on one side surface in each air chamber 127 is electrically connected through the corresponding metal electrode 109 to the metal electrode 8 formed on one side surface in another air chamber 127 adjacent to the above air chamber 127 with the ink chamber 104 interposed therebetween. Furthermore, the metal electrode 117 is formed on the upper surface 110C of the cover plate 110 at the rear portion between the center and the rear end surface 110B and on the whole of the opposed side surfaces of the slits 111B. Accordingly, the metal electrodes 8 in all the ink chambers 104 are electrically connected together by the metal electrode 117.

In this manner, the metal electrodes 8 in all the ink chambers 104 can be electrically connected together and the metal electrodes 8 in the air chambers 127 defined on both sides of each ink chamber 104 can be electrically connected together without providing the shallow grooves 7 and the flat portion 16 formed in the first preferred embodiment. Accordingly, the material of the piezoelectric ceramics plate 102 can be made less in amount than the piezoelectric ceramics plate 2 of the first preferred embodiment, thereby reducing the cost. Further, the metal electrodes 109 and 117 are electrically connected to the patterns 124 and 125 formed on the flat upper surface 110C of the cover plate 110, respectively. Accordingly, the patterns 124 and 125 can be electrically well connected to the wiring patterns on the flexible printed board with ease. In addition, the electrical connection can be ensured by suitably setting the shapes and the sizes of the patterns 124 and 125.

The patterns 124 and 125 formed on the cover plate 110 may be directly connected to the rigid board connected to the control section without using the flexible printed board.

Further, the width of each air chamber 127 may be set smaller than the width of each ink chamber 104, thereby reducing the width of the piezoelectric ceramics plate 102.

Although the grooves 3 and 103 are formed on the upper surfaces of the piezoelectric ceramics plates 2 and 102 in the first and second preferred embodiments, these grooves may be formed on the upper and lower surfaces of the piezoelectric ceramics plate with the thickness of the piezoelectric ceramics plate increased, thus forming the arrays of the ink chambers and the air chambers on both surfaces of the piezoelectric ceramics plate.

What is claimed is:

1. An ink ejecting apparatus, comprising:

a plurality of ejecting chambers from which ink is ejected;

a plurality of non-ejecting chambers from which no ink is ejected, said plurality of non-ejecting chambers disposed between said plurality of ejecting chambers alternately;

a plurality of side walls, each side wall disposed between one of said plurality of ejecting chambers and one of said plurality of non-ejecting chambers, said plurality of side walls being formed of piezoelectric ceramics polarized in a first direction;

a plurality of first electrodes provided on a surface of said plurality of side walls for generating an electric field having a direction perpendicular to the first direction of polarization of said side walls whereby the ink is ejected from said ejecting chambers;

a plurality of first shallow grooves communicating with said ejecting chambers and being shallower than said ejecting chambers;

a plurality of second electrodes formed on surfaces of said first shallow grooves and being electrically connected to said first electrodes disposed in said ejecting chambers;

a plurality of second shallow grooves communicating with said non-ejecting chambers and being shallower than said non-ejecting chambers and having a different depth than said first shallow grooves; and a plurality of third electrodes formed on surfaces of said second shallow grooves and being electrically connected to said first electrodes disposed in said non-ejecting chambers.

2. The ink ejecting apparatus according to claim 1, wherein said ejecting chambers and said non-ejecting chambers are defined by forming a plurality of grooves on a piezoelectric ceramics plate polarized in the first direction and covering top openings of the plurality of grooves with a cover plate.

3. The ink ejecting apparatus according to claim 2, wherein the cover plate has an ink supply portion for supplying the ink only to said plurality of ejecting chambers.

4. The ink ejecting apparatus according to claim 1, wherein the plurality of second shallow grooves are deeper than the plurality of first shallow grooves.

5. The ink ejecting apparatus according to claim 4, wherein said plurality of second shallow grooves are longer than said first shallow grooves.

6. The ink ejecting apparatus according to claim 5, further comprising a fourth electrode electrically connected to all of said plurality of third electrodes.

7. The ink ejecting apparatus according to claim 6, wherein said second shallow grooves are deeper than said first shallow grooves, and the fourth electrode is formed on one of a surface lower than bottom surfaces of said first shallow grooves and the surface where the fourth electrode is formed is one of above bottom surfaces of said second shallow grooves and at a same level with bottom surfaces of said second shallow grooves.

8. The ink ejecting apparatus according to claim 4, further comprising a separation groove deeper than said first shallow grooves and shallower than said second shallow grooves.

9. The ink ejecting apparatus according to claim 8, further comprising a fourth electrode electrically connected to all of said plurality of third electrodes, wherein said plurality of second electrodes are made electrically independent of each other by said separation groove.

10. An ink ejecting head, comprising:

a first plate having a plurality of grooves formed therein with walls between each of the grooves and having a direction of polarization;

a second plate mounted to a free end of said walls to convert said plurality of grooves into a plurality of chambers, said plurality of chambers divided into at least a first subset and a second subset;

a plurality of first electrodes located on each side of each of said walls;

means for supplying ink to each chamber of said first subset;

a second electrode electrically connected to the first electrodes on opposite walls in one chamber of said first subset; and a third electrode electrically connected to said first electrodes in each chamber in said second subset, wherein said first electrodes in one of said first subset and said second subset introduce an electrical field transverse to the direction of polarization, said first subset providing ink chambers and said second subset providing air chambers with said first subset and said second subset so positioned that an ink chamber has an air chamber on each side thereof, each of said ink chambers and each of said air chambers have a first portion and a second portion with different depths, a depth of the first portion greater than a depth of the second portion, wherein the depth of the second portion in said air chambers is different from the depth of the second portion in said ink chambers.

11. The ink ejecting head as claimed in claim 10, further comprising a control circuit connecting a clock circuit, a data line, a voltage line, a ground line, said plurality of second electrodes and said third electrode on the basis of data input through the data line.

12. The ink ejecting head as claimed in claim 10, wherein said third electrode is electrically connected to said first electrodes in said air chambers.

13. The ink ejecting head as claimed in claim 10, wherein the second depth in said air chambers is greater than the second depth in said ink chambers.

14. The ink ejecting head as claimed in claim 13, said first plate further comprising a flat portion adjacent said second depths of said ink and air chambers;

a groove transverse to said grooves in said first plate, said transverse groove having a depth between the second depths of said air and ink chambers thereby isolating said first electrodes in said ink chambers; and a fourth electrode on said flat portion electrically connecting said third electrode with said first electrodes in said air chambers, wherein each of said plurality of second electrodes is electrically connected to said first electrodes on opposite walls in one of said ink chambers.

15. The ink ejecting head as claimed in claim 12, wherein said cover has a manifold and a plurality of orifices, each orifice connecting the manifold to one of said ink chambers.

16. The ink ejecting head as claimed in claim 13, said first plate further comprising:

a recessed flat portion, said recessed flat portion recessed to a depth equal to the second depth of said air chambers and connecting with the second depths of said air chambers thereby isolating said second depths of said ink chambers;

a fourth electrode on said recessed flat portion electrically connecting said third electrode with said first electrodes in said air chambers, wherein each of said plurality of second electrodes is electrically connected to said first electrodes on opposite walls in one of said ink chambers.

17. The ink ejecting head as claimed in claim 12, said first plate further comprising:

a flat portion adjacent an end of said ink and air chambers, said air chambers having a greater length than a length of said ink chambers; and a fourth electrode on said flat portion to electrically connect said third electrode and said first electrodes in said air chambers, wherein each of said plurality of second electrodes is electrically connected to said first electrodes on opposite walls in one of said ink chambers.

18. An ink ejecting head, comprising:

a first plate having a plurality of grooves formed therein with walls between the grooves and having a direction of polarization;

a second plate mounted to a free end of said walls to convert said plurality of grooves into a plurality of chambers, said plurality of chambers having at least a first subset of chambers and a second subset of chambers;

a plurality of first electrodes located on each side of each of said walls;

means for supplying ink to each chamber of the first subset of said plurality of chambers;

a second electrode electrically connected to said first electrodes in said first subset of chambers; and a plurality of third electrodes, each third electrode electrically connected to one first electrode in a chamber of the second subset of chambers on each side of a chamber of said first subset of chambers, said first electrodes on the walls of the second subset of chambers for introducing an electrical field transverse to the direction of polarization, wherein said second plate has a plurality of slits on either end, said slits on a first end corresponding to said second subset of chambers and said slits on a second end corresponding to said first subset of chambers, and further comprising a manifold member mounted to said second end for feeding ink to said first subset of chambers through said slits on said second end.

19. The ink ejecting head as claimed in claim 18, further comprising a control circuit, said control circuit connecting a clock circuit, a data line, a voltage line, a ground line, said second electrode and said plurality of third electrodes on the basis of data input through the data line.

20. The ink ejecting head as claimed in claim 18, wherein said first subset of chambers are ink chambers and said second subset of chambers are air chambers with said first and second subsets so positioned that an ink chamber has an air chamber on each side thereof.

21. The ink ejecting head as claimed in claim 20, wherein said second electrode is electrically connected to said first electrodes in said ink chambers.

22. An ink ejecting apparatus, comprising:

a plurality of ejecting chambers from which ink is ejected;

a plurality of non-ejecting chambers from which no ink is ejected, said plurality of non-ejecting chambers disposed between said plurality of ejecting chambers alternately;

a plurality of side walls, each side wall disposed between one of said plurality of ejecting chambers and one of said plurality of non-ejecting chambers, said plurality of said walls being formed of piezoelectric ceramics polarized in a first direction;

a plurality of first electrodes provided on a surface of said plurality of side walls for generating an electric field having a direction perpendicular to the first direction of polarization of said side walls whereby the ink is ejected from said ejecting chambers;

a plurality of first shallow grooves communicating with said ejecting chambers and being shallower than said ejecting chambers;

a plurality of second shallow grooves communicating with said non-ejecting chambers and being shallower than said non-ejecting chambers, wherein each first shallow groove of the plurality of first shallow grooves and each second shallow groove of the plurality of second shallow grooves have at least one of a different depth and a different length; and means for connecting the plurality of first electrodes in one of the plurality of ejecting chambers and the plurality of non-ejecting chambers to a common electrode.

23. An ink ejecting head, comprising:

a first plate having a plurality of grooves formed therein with walls between the grooves and having a direction of polarization;

a second plate mounted to a free end of said walls to convert said plurality of grooves into a plurality of chambers, said plurality of chambers having at least a first subset of chambers and a second subset of chambers;

a plurality of first electrodes located on each side of each of said walls;

means for connecting said first electrodes in said first subset of chambers to a common electrode;

a plurality of second electrodes, each second electrode electrically connected to said first electrodes in a chamber of said second subset of chambers;

a plurality of first shallow grooves communicating with said first subset of chambers and being shallower than said first subset of chambers; and a plurality of second shallow grooves communicating with said second subset of chambers and being shallower than said second subset of chambers and having a different depth than said plurality of first shallow grooves.

24. The ink ejecting apparatus according to claim 23, wherein said first shallow grooves are deeper than said second shallow grooves.

25. The ink ejecting apparatus according to claim 23, wherein said first shallow grooves have a different length than said second shallow grooves.

26. The ink ejecting apparatus according to claim 22, wherein each first shallow groove of the plurality of first shallow grooves is at least one of deeper and longer than each second shallow groove of the plurality of second shallow grooves.

* * * * *

UNITED STATES PATENT AND TRADEMARK OFFICE

CERTIFICATE OF CORRECTION

PATENT NO. : 5,625,393

DATED : April 29, 1997

INVENTOR(S) : Hiroki ASAI

It is certified that error appears in the above-identified patent and that said Letters Patent is hereby corrected as shown below:

On the title page,

Add:

[73] Assignee: Brother Kogyo Kabushiki Kaisha
Nagoya, Japan

Attorney, Agent, or Firm - OLIFF & BERRIDGE

Signed and Sealed this

Third Day of March, 1998

*Attest:*

*Attesting Officer*

Bruce Lehman

BRUCE LEHMAN

*Commissioner of Patents and Trademarks*